United States Patent [19]

Gladden, Jr. et al.

[11] 4,203,268

[45] May 20, 1980

[54] STRUCTURAL MEMBER AND COMPOSITE PANEL INCLUDING SAME

[75] Inventors: Robert S. Gladden, Jr., Severna Park; Richard J. Johnson; Michael J. Karmazyn, both of Baltimore; Donald L. Tate, Severna Park, all of Md.

[73] Assignee: Tate Architectural Products, Inc., Jessup, Md.

[21] Appl. No.: 885,991

[22] Filed: Mar. 13, 1978

[51] Int. Cl.[2] ..... E04C 2/32

[52] U.S. Cl. ..... 52/630; 428/176

[58] Field of Search ..... 52/792, 795, 806, 630; 428/178

[56] References Cited

U.S. PATENT DOCUMENTS

| | | | |
|---|---|---|---|
| 3,196,763 | 7/1965 | Rushton | 94/11 |
| 3,279,973 | 10/1966 | Arne | 52/792 X |
| 3,527,664 | 9/1970 | Hale | 52/792 X |
| 3,892,902 | 7/1975 | Ilukowicz | 428/178 X |

FOREIGN PATENT DOCUMENTS

| | | | |
|---|---|---|---|
| 1433453 | 2/1966 | France | 52/792 |

*Primary Examiner*—Carl D. Friedman
*Attorney, Agent, or Firm*—C. Hercus Just

[57] ABSTRACT

A structural member comprising a sheet of industrial material in which is formed a plurality of dome-like projections of which at least the major portion of the configuration thereof in plan view is circular and said projections being located in the plane of said sheet in a structurally strategic geometric pattern which repeatedly blocks straight lines of vision across said sheet through said pattern of projections in all directions to form a one-piece rigid structural member capable of resistance to flexure and the intermediate portion of the sheet between said projections comprising arcuate continuous structural stress-resisting sections extending between the opposite edges of said member. Variations in patterns of projections comprise different embodiments of said member and, when fabricated, said member lends itself to a variety of end uses. When in the form of a composite panel, a flat sheet of planar material is affixed to the upper ends of said projections. The perimeter of said composite panel can also be provided with an integral bracing flange extending from the periphery of said member and terminating in an outwardly extending lip substantially within a plane common to the upper ends of said projections and when thus fabricated so lends itself particularly to a more specific and substantially more beneficial end use, such as in the art of access flooring.

25 Claims, 23 Drawing Figures

STRUCTURAL MEMBER AND COMPOSITE PANEL INCLUDING SAME

BACKGROUND OF THE INVENTION

The advent of computers in recent years gave rise to the development of what is known as access flooring. Such flooring comprised a modular embodiment of rigid structural floor panels supported on pedestal columns and frequently requiring beam-like stringer members spanned between said columns for edge reinforcement. Typical assemblies were installed on top of a supporting subfloor, thus providing an adequate and secluded space to accommodate an array of power cables and the like beneath the readily accessible floor panels. This underfloor space or cavity also served well as a distribution plenum for conditioned air. Change in location and frequent servicing of computerized equipment in an access floor environment requires repetitive physical handling of the interconnecting cables and is accomplished quite easily by the temporary removal of such modular panels. Subsequently, the underfloor cavity is exposed for complete freedom to perform any task within the maze of previously hidden wiring. When such work is finished, the modular panels fit quickly and easily back into their original position, thereby returning the area to a totally unobstructed and uniform top floor surface.

In view of the weight of computers and other equipment, it was essential that the modular floor panels be substantially rigid, such that when loaded they do not appreciably allow flexure or retain permanent set once flexed, so that the access floor is uniformly flat and all panels are in a common plane. To accomplish this, some of the earlier panels were made of substantially reinforced metal encased wood and heavy metalic castings but this has been appreciably abandoned in favor of lighter weight, high strength metal sandwich panels of which the panel comprising the subject matter of U.S. Pat. No. 3,236,018, to Graham et al, dated Feb. 22, 1966, is an example which is popular and is still being produced and used extensively in the industry.

In recent years, the access flooring industry has expanded in two ways. The first is in the field of high performance, heavy duty panels for specific heavy load areas above and beyond standard computer room criteria. Secondly, the access floor industry has been expanding more and more into office renovation and general office construction for new buildings and other typical lighter load applications. A dramatic shift in the performance requirements for this type of general construction floor has substantially taken place.

Current art has attempted to economically satisfy this need by means of altering panel designs by varying material thicknesses, but sometimes by discarding the standard stringer support provided at the panel edge. Although this readily achieves a lighter weight and more economical product, it inherently introduces an objectionable deficiency, namely, edge-to-edge movement, in the character of the system as viewed by architects and users who are foremost aesthetically minded. Another prominent objection is related to the feel of springiness within a light-weight floor under normal foot traffic. Insecure feelings also arise due to the visible edge-to-edge movement between panels under light equipment use. Although the structural integrity, specifically the ultimate strength, more than satisfies the most stringent general office construction criteria, this objectionable panel-to-panel motion is a restricting factor to the growth and acceptance of the product in the general construction and renovation market.

The industry, to satisfy this need, has developed systems which reduce perimeter movement by adding secondary structures, such as perimeter stringers or complex panel-to-panel hard connecting devices. Although such structures tend to reduce edge-to-edge movement, they directly affect the accessibility and ease of handling the floor system as originally conceived.

Additionally, in renovations and, more importantly, in general office construction, it is desirable to hold the finished floor height of the access floor to a minimum while providing an adequate space or cavity for underfloor cables and to perform as an air distribution plenum. Thicker panels diminish vital underfloor clearance or floor-to-ceiling height. The thickness of the access floor panel is often as much as one-third of the total of this low finished floor height; therefore, an economical panel with needed structural properties, yet thinner in depth, is an advancement in the art and a savings in total building height and cost for new construction, and also provides the ability to maintain adequate minimum floor-to-ceiling height in renovations. To do this, the structural efficiency of the panel has to be dramatically increased over existing art, especially at the perimeter.

Since the development of the aforementioned patented panel, efforts have been made to simplify and also reduce the weight and the amount of metal required in said panels, without reducing, but instead, striving to increase the resistance of the panels to flexure and/or permanent set, especially at the panel perimeter when subjected to static or moving loads. This has resulted in explorations and development, especially in the design, of the structural member which is primarily the lower stress member in a metal sandwich-type floor panel in which it is able to perform integrally with the upper planar member upon which the load is usually imposed.

In such exploration, we have determined that a key factor to resistance to flexure is the reduction of clear straight lines of vision through said sandwich panel and, more importantly, the repeated blockage in all directions within the sandwich. It has been found that several patterns of projections with common strategic dimensional relationships can provide both necessary blockage of clear lines of vision and suitable support of the top sheet to resist localized indentation of the access floor panel. Projections were selected because they combined the benefits of a continuous bottom member with the support obtained from arch-shaped projections to prevent collapse thereof, together with an optimum depth which, combined with the structural and economic efficiency of the section, developed blockage of "see through", thereby providing sufficient section properties to resist deflection by the loads applied.

The strategic dimensional relationship is a combination of considerations for five major characteristics of the projections and their interrelation; namely, (1) depth of projections for needed section modulus and moment of inertia; (2) diameter of projections to obtain their needed depth; (3) distance between the centerlines of projections for sufficient top sheet support; (4) strategic positioning of projections to repeatedly block clear lines of vision throughout the member; and (5) remaining bottom surface material adequate to perform as a stress member and also develop necessary section modulus and moment of inertia. Prior art has failed to combine and/or incorporate one or more of these five structurally significant characteristics and has, therefore, accomplished a less than optimum one-piece structural member which, when combined with a top sheet, does not provide an economical metal sandwich construction of desired comparable strength-to-weight ratio or structural efficiency.

It has been found that specific patterns of several different embodiments of projections, in which at least the major portions of the configuration of said projections are circular and details of which are described fully hereinafter, results in increased rigidity and resistance to flexure to a marked extent. Said projections are formed in sheets of planar industrial material of lighter gauge than now employed in the floor panel of the type shown in said aforementioned U.S. Pat. No. 3,236,018 for improved performance under the same load conditions. The efficiency in performance of the developed core structure has thus been dramatically improved. Such characteristics and features are not found in the prior art, notwithstanding the disclosure of formed sheets having various types of projecting ribs and/or figures of a regular contour pressed from planar sheets and other means which block straight lines of sight across the formed sheet and through such ribs and figures, either because the configurations do not permit sufficient depth of section for strength purposes, are not sufficiently conducive to resist flexure under the required loads existing in access floor use, or are not economical to competively market the same.

The prime object of this present invention is to form, within a single sheet, a structurally efficient combination core and bottom stress member which when affixed to a planar top member surpasses the combined strength, rigidity, and economics of prior art.

SUMMARY OF THE INVENTION

One of the principal objects of the invention is to provide a one-piece rigid structural member capable of resistance to flexure by the formation of a sheet of structural material to include a plurality of dome-like projections which extend from the original plane of the sheet and in which at least the major portion of the configuration of each projection is circular in plan view. Said projections are arranged in said sheet in a structurally strategic geometric pattern of which rows of pairs of dome-like projections are in a straight line in any direction and said rows are in a perpendicular basket weave pattern relative to each other. Said pattern repeatedly blocks straight lines of clear vision in all directions across said sheet and therefore, the occurrence of said projections in said sheet is such that the spaces between adjacent projections is inadequate to accommodate another similar projection. Said projections are spaced from each other a limited distance to provide therebetween intermediate continuous structural ribbon-like stress sustaining sections of fluctuating width capable of optimizing stress-resisting integrity and the same being arcuate in plan view and extending between the opposite edges of said sheet to sustain the stresses under load conditions. Such a structural member may be utilized in the manufacture of composite sections, such as access flooring, decking, or other structures which require economical high strength-to-weight ratios and structural efficiency. Additionally, they can provide structural components as in the construction of walls and other reinforcements where the individual sheet is utilized as an intermediate core member, or by itself, as a flexure-resisting component. Such one-piece structural members readily satisfy demands and applications in such marketable products as roofing, decks, wall constructions and a variety of other applications to provide structural efficiency.

An additional object of the invention is to maintain said arcuate structural ribbon-like stress sections in their original shape under stress by the circular configuration of said projections converting load stresses, which would tend to straighten said sections, into hoop stresses around said projections, thereby resisting said tendency to straighten said sections.

A further object of the invention is to isolate any reduction in material thickness to substantially within the formed area of the projections themselves. This leaves optimum material in the stress-sustaining sections located where maximum section properties can be developed.

A further object of the invention is to provide repeated blockage of clear lines of sight across said sheet in all directions. This is accomplished by several embodiments of patterns of projections, such as when the bases of said projections formed in a sheet of material are substantially circular in plan view, and when said projections are combined in groups of four and arranged in a rhombus pattern of a structurally strategic dimensional relationship between the diameter of said projections and the center-to-center distance therebetween, and adjacent rhomboidal patterns are positioned in a close perpendicular basket weave orientation. Said basket weave orientation in a structurally strategic geometric pattern also is produced by rows of pairs of equally-spaced in-line projections being interwoven perpendicularly with other such rows of pairs in a basket weave fashion, so that the portions of a centerline of a row of pairs of projections that lies between two aligned pairs bisects the pairs thereof in transverse rows, as shown by dotted lines in FIG. 13, and also provides sufficient pattern density to block straight lines of clear vision repeatedly in all directions across said sheet to form a one-piece rigid structural member capable of resistance to flexure. Additionally, this is accomplished in a pattern wherein the projections are arranged in pairs connected by a saddle portion to form an elongated configuration which in plan view generally resembles a figure 8, peanut-like in shape, and the ends of said elongated projections being circular and said elongated configurations also being arranged in a substantially basket weave pattern which establishes a structurally strategic dimensional relationship between the diameter of said projections and the center-to-center distances therebetween and in which, in plan view, the end of one elongated configuration interfits with the adjacent configurations in such manner as to block straight lines of vision through said patterns. Similarly, blocking is accomplished by arranging a plurality of projections having rounded outer ends in close proximity to each other within the pattern in which certain of said projections are circular in cross-section and others are in plural arrangements to form elongated configurations which resemble at least a figure 8, in plan view, and at least a major portion of the circumference of all projections are circular in plan view, and the combinations of said projections in said sheet being such as to repeatedly block straight lines of clear vision across said sheet. Finally, blockage is accomplished by including at least one drawn section formed from the original planar sheet in the same direction as said projections, said drawn section having an area larger than said projections surrounding said pattern. The arrangements of said projections and drawn section are designed so as to repeatedly block clear lines of vision across said sheet. The blocking of clear lines of sight repeatedly across said sheet provides a structural member of increased resistance to flexure due to increased structural efficiency, and when combined with a planar top sheet becomes an economical composite structural unit of substantially greater strength than one in which lines of clear vision are present around which the structural unit can be flexed.

Still another object of the invention is to provide the location of said projections in such manner that a composite unit which is resistant to flexure is substantially isotropic, whereby said unit when penetrated by an opening of limited cross-section located inward from the edges is resistant to flexure due to the resulting stresses in said unit when under load being redirected around said opening. This provides a unit which can be utilized as an access floor panel or other wall panel uses in which ready penetration can be made without significant reduction in the structural integrity of the unit in order to provide penetrations for cables, pipes, or other accesses as needed in the construction industry.

One further important object of the invention is to combine any of the previously described patterns of projections in a structural member with a flat sheet of structural material of similar size and shape and fixedly connect the upper ends of said projections to said flat sheet to form a composite structural panel in which said sheet of said panel is disposed uppermost in use, thereby forming load-carrying composite structures useable in many industrial applications.

A still further object is utilization of this composite structural member in the fabrication of access floor panels wherein the perimeter of said structural member has the outer edge portions formed at right angles to said member to provide a continuous bracing flange around the panel of a given finite size to provide a panel which can be selectively supported at the edges or corners thereof and which can accept substantial uniform or concentrated loads, such as those seen in access flooring applications.

A still further object of the invention is to provide an integral perimeter lip bent outward from said peripheral bracing flange to provide an additional connection between said member and said top sheet which is utilized as a stiffened lip by which the access floor panel can be selectively supported at the corners or along the perimeter to develop an access floor system in combination with pedestals and/or stringers.

A still further object of the invention is to provide said peripheral bracing flange with a greater transverse depth relative to said intermediate portion of said structural member between said projections, and in which said depth is greater than the height of said projections and a portion extending in the opposite direction from said projections and another portion extending in the same direction as said projections to provide a perimeter of increased strength and resistance to flexure, especially when utilized as an access floor panel without the use of secondary members, such as stringers or more complicated panel-to-panel hard connecting devices to prevent edge-to-edge movement.

Another object is to form said structural member in such manner that all surfaces of said projections and the junctures thereof with said intermediate structural stress sections in the original plane of said sheet are free from sharp edges or bends whereby there are no areas or portions in said sheet which comprise corners or other shapes which normally tend to pucker or otherwise resist formation of smoothly stretched areas when formed from planar sheets and subjected to shaping by dies.

One further object of said invention is to provide a structural member which can be combined with a similar member and fixedly connected, end-to-end, to provide a composite core structure which can be utilized in industrial application, especially where high strength-to-weight ratio properties are desired and which do not necessarily require a flat planar sheet. Flat planar sheets may be added to this composite structure if desired.

BRIEF DESCRIPTION OF THE DRAWINGS

FIG. 1 is a plan view of a fragment of a structural member embodying the principles of the present invention in which one embodiment of dome-like projections are formed, said figure illustrating diagrammatically broken lines tracing arcuate structural stress sections of said member, which are ribbon-like.

DETAILED DESCRIPTION

Figure 1:
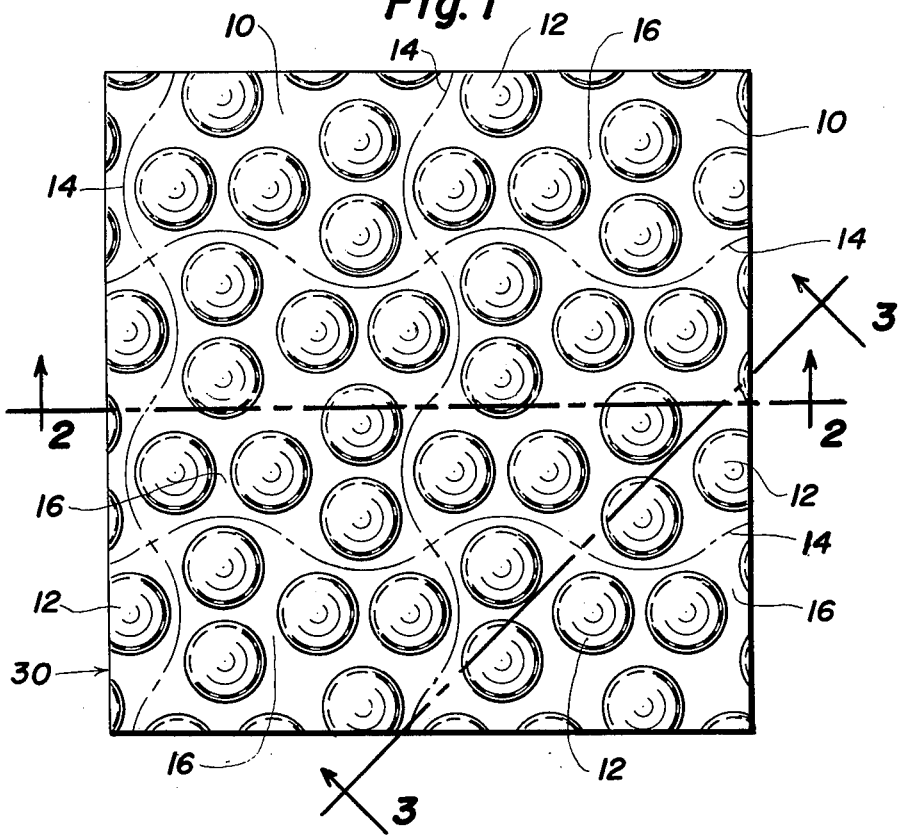

The most important part of the present invention comprises a one-piece structural member formed from a sheet of industrial material which, preferably comprises metal, such as steel, for example, but for certain applications of the invention, other industrial material, such as certain plastics, may be employed. Particularly when made from metal, a sheet of such industrial materials is subjected to appropriate punches and dies respectively for forming a plurality of any one of a number of different shapes, kinds, and patterns of projections, details of which are described hereinafter, said projections preferably extending from one surface of the sheet of material and all the upper ends of said projections preferably being substantially within the same plane. Except for the integral edge construction which may be formed simultaneously from within said sheet, all surfaces of the major portion of the sheet are smoothly curved and are free from sharp angles or bends which otherwise would comprise corners or other shapes which normally tend to pucker or resist formation of smoothly stretched areas when formed from a planar sheet and subjected to shaping by such punches and dies. Except for the possibility of forming a limited number of holes or openings in the sheet, such as for the transmission of air in certain applications of the invention, the formed sheet is substantially imperforate.

To provide an understanding of certain terms used in the specification and claims of this application, the following definitions are set forth:

DEFINITIONS

1. Stress section—The portion of the structural member between the projections designed to withstand tensile and compressive stresses.

2. Structurally strategic geometric pattern—the dimensional relationship and orientation of projections in which the following five major characteristics are strategically interrelated:

(1) depth of projection for needed section modulus and moment of inertia;

(2) diameter of projections to obtain needed depth;

(3) distance between the centerlines of projections for adequate top sheet support;

(4) strategic positioning of projections to repeatedly block clear lines of vision throughout the member;

(5) remaining bottom surface material adequate to perform as a stress member and also provide necessary section modulus and moment of inertia.

3. Structural unit—a unit of two or more members, which when combined provide a substantial increase in section modulus and strength-to-weight ratio over these same properties of the individual members.

4. Substantially hemispherical dome-like projections—projections having radiused contours in all directions of one or a combination of radii to provide arches for top sheet support and to develop optimum height for increased section modulus.

5. Fixedly secured—any means causing two members to work together as a composite unit, such as welding, riveting, use of structural adhesives, direct fusion or other known methods.

6. Optimization of support—providing specific density of projections in a base sheet of material, such that they prevent localized indentation of the top sheet when used as a composite unit, providing frequency of load transfer from the top sheet to the structural member and minimizing top sheet thickness while optimizing strength-to-weight ratio of the unit.

7. Straight lines of vision—visible longitudinal openings providing direct open paths through a composite section around which the section can bend or flex and through a member around which the member can flex. Increased frequency of blockage is directly proportional to increased resistance to flexure.

8. Rhombus pattern—geometric pattern of an equilateral parallelogram having oblique angles wherein the centers of the projections are located at corners of a rhombus.

9. Basket weave orientation—the combination of patterns of pairs of projections or elongated configurations interlaced or intermeshed and in which one pattern is perpendicular to an adjacent pattern so that a straight line of sight therebetween is intercepted, thus providing a unique pattern of location and density for sufficient top sheet support and optimum strength-to-weight ratio.

10. Saddle portion—material unrestrained by the die during pressing, located betweeen two dome-like projections in an elongated configuration, which is unrestricted at the original plane of the member, and is naturally stretched down between the projections usually to a depth less than, but may be equal to, the depth of the projections. When depth of the saddle portion is made equal to the depth of projections as when formed with a die, the saddle portion provides additional top sheet support.

11. Elongated configuration—a combination of two or more projections with the saddle portion extending between said projections, and resembling at least a figure 8, peanut-like in shape.

12. Arcuate structural stress members—stress members between said projections of the sheet, sinuous in shape and held in their configuration when under stress by the circular ends of the projections acting to resist deformation and tendency to straighten.

13. Continuous bracing flange—the edge termination of a member of finite size and perpendicular thereto which provides continuous built-in means of edge stiffening.

14. Peripheral lip—the return of the outermost edge portion of the continuous bracing flange to dispose it in the same plane as the terminal ends of said projections and when affixed to a top sheet, provides a means of selectively supporting a panel at the corners and/or edges thereof.

15. Greater transverse depth—additional depth provided at the edge termination of a member of finite size, said depth being deeper than said projections and providing added edge stiffness.

16. Isotropic—load-resisting properties of a composite unit having substantially the same values when measured along axes in all directions and which is substantially free from directional weakness when the unit is penetrated by holes, cutouts, and the like.

17. Structural efficiency—the efficient design and utilization of structural components in such a way as to permit the use of shallower sections and thinner materials in lieu of deeper sections and heavier materials while developing equal or better moment of inertia and/or more balanced section modulus. Relative structural efficiencies of two units expressed as a percentage, said units under the same load and support conditions, is determined by the following formula:

$$\frac{\text{Deflection Unit \#1}}{\text{Deflection Unit \#2}} \times \frac{\text{Mass weight Unit \#1}}{\text{Mass weight Unit \#2}} \times \left(\frac{\text{Section depth Unit \#1}}{\text{Section depth Unit \#2}}\right)^2 \times 100$$

18. Hoop Stress—Tensile or compressive stress in a circular member acting circumferentially. Because of symmetry of the member, there is no tendency for any part of the circumference to depart from the circular form under load as long as the hoop stress remains below the yield point of the material.

19. Directional weakness—appreciable loss of strength in a structural unit caused by planes of flexural weakness that are developed by penetration of said structural unit and around which planes the unit readily flexes relative to flexure in other directions.

20. Strength-to-weight ratio—ratio of the mathmatical product of deflection times mass for one unit compared to the same ratio for a second unit. The strength-to-weight ratio is used to determine minimum weight consistent with the geometry of the unit required to maintain the integrity of the unit to resist flexure. Relative strength-to-weight ratios of two units expressed as a percentage—said units under the same load and support conditions is determined by the following formula:

$$\frac{\text{Deflection Unit \#1}}{\text{Deflection Unit \#2}} \times \frac{\text{Mass weight Unit \#1}}{\text{Mass weight Unit \#2}} \times 100$$

PREFERRED EMBODIMENTS OF THE INVENTION

Figure 2:
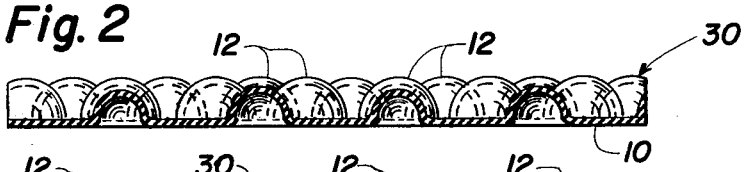
FIG. 2 is a fragmentary vertical sectional view of the structural member shown in FIG. 1, as seen on the line 2—2 thereof.
Figure 3:
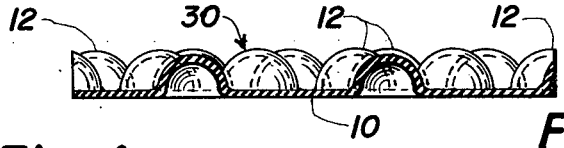
FIG. 3 is a fragmentary sectional view similar to FIG. 2 but showing the cross-section of the member shown in FIG. 1, as seen on the line 3—3 thereof.

Referring to FIG. 1, there is shown therein a fragmentary section of a sheet 10 of structural material, which initially is planar and the same is subjected to a set of dies to form therein a plurality of projections 12 which, as will be seen from FIGS. 2 and 3, are dome-shaped and are substantially hemispherical in cross-section. This arrangement provides one embodiment of projections which adapts itself to being disposed in patterns, such as shown in one exemplary manner in FIG. 1, in which said projections are in close relationship to each other and therefore, are frequently disposed throughout the sheet, in rows of pairs of equally-spaced in-line projections that are interwoven perpendicularly in basket weave fashion, and as further illustrated diagrammatically by dotted lines in FIG. 13, the portions of a centerline of a row of pairs that lies between two aligned pairs bisects the pairs thereof in rows transverse thereto. Said projections are spaced a limited distance from each other so as to provide therebetween sections of the original sheet which are arcuate as indicated by the exemplary, somewhat sinuous diagrammatic line 14, which outlines the intermediate continuous planar structural ribbon-like stress sections 16 of the original sheet 10.

Figure 14:
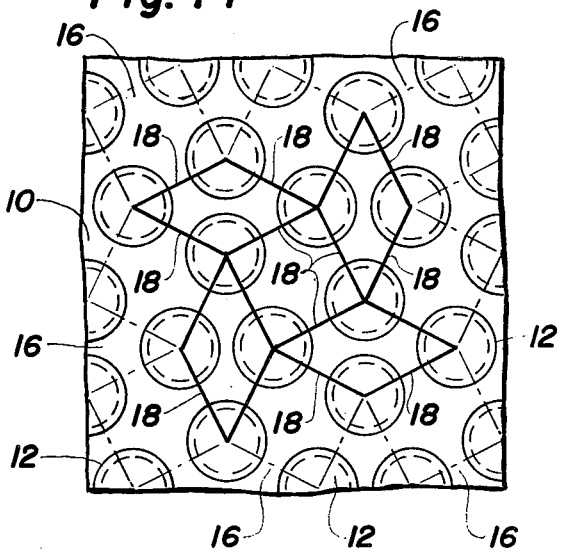
FIG. 14 is a diagrammatic view of a section of a structural member similar to that shown in FIGS. 1–3 and illustrating by outline, rhombus figures extending between the centers of clusters of four projections and the pattern of said outline illustrating a basket weave pattern in which said clusters of projections are disposed.
Figure 15:
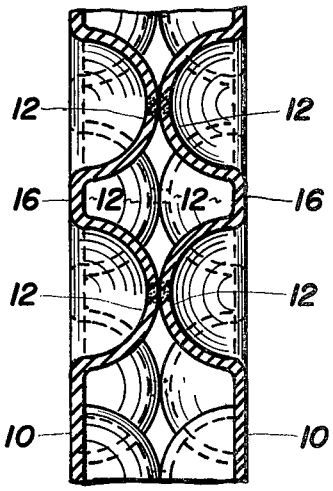
FIG. 15 is a fragmentary vertical section illustrating a pair of the structural members of the embodiment illustrated in FIGS. 1–3 disposed in bottom-to-bottom relationship in which the outermost ends of the projections of said members abut and are connected together.
Figure 13:
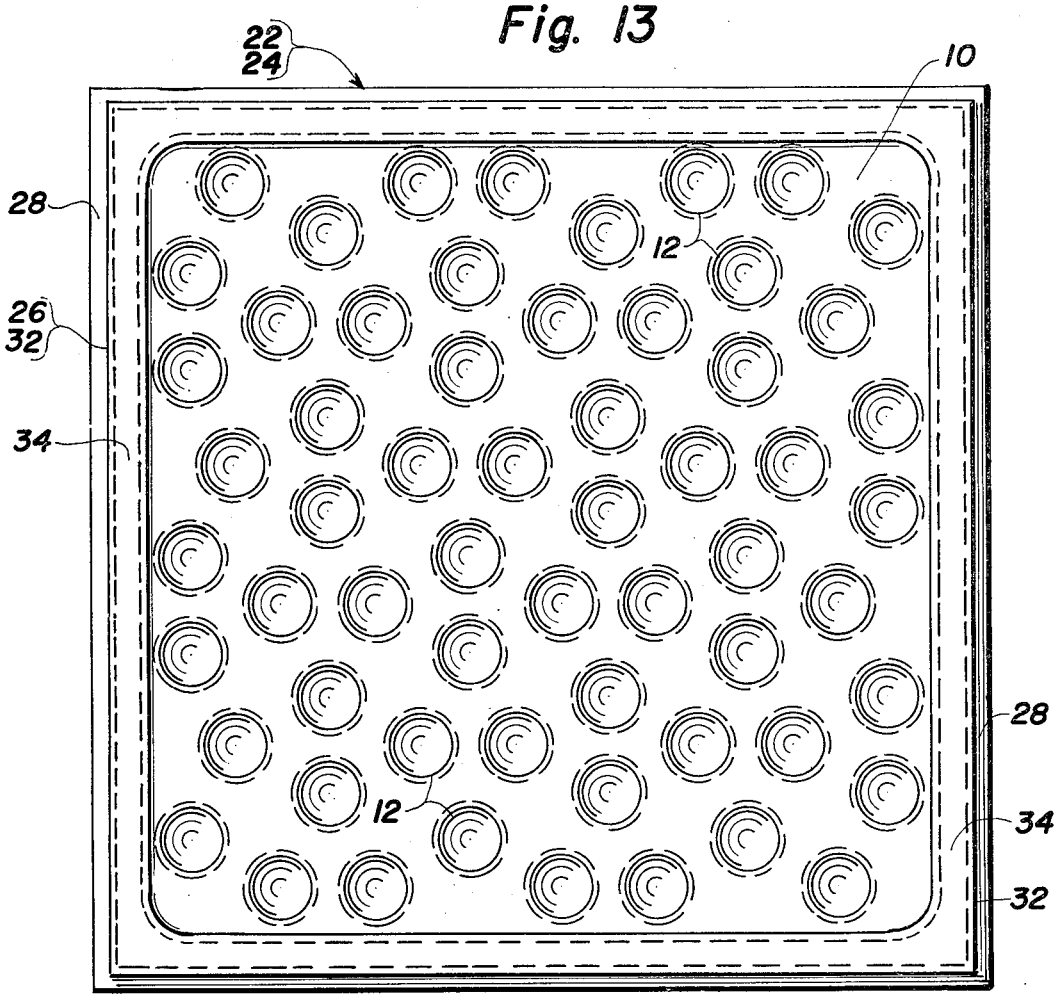
FIG. 13 is a bottom plan view of another embodiment of panel similar to that shown in FIGS. 1–5 and in which the structural member shown in said figures has been included in said panel said view also showing diagrammatically the portions of centerlines of a row of pairs of projections that lie between two aligned pairs bisecting the pairs thereof in transverse rows in the perpendicular basket weave arrangement of rows of pairs of said projections.
Figure 18:
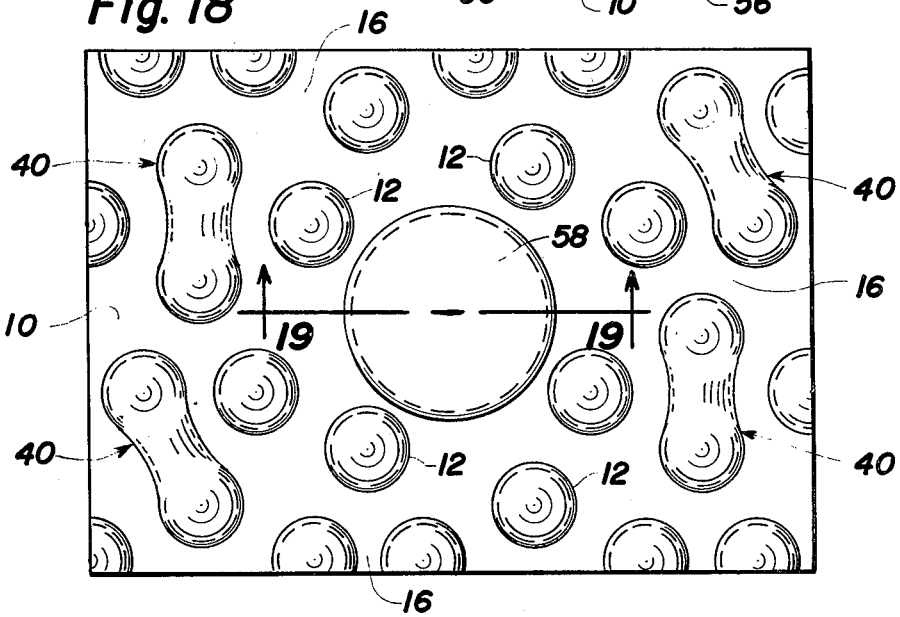
FIG. 18 is a fragmentary exemplary plan view of still another embodiment of arrangement of projections formed in a structural member similar to the embodiments previously illustrated in FIGS. 1 and 8 but in which still another arrangement of projections is shown.

It also will be observed from FIG. 1 that the projections 12 are arranged in said sheet in such manner that only a limited number, such as pairs of evenly spaced projections are disposed in what might be considered a straight line and, preferably, the projections are disposed in patterns in which a preferred arrangement, such as a perpendicular basket weave configuration, shown diagrammatically in FIG. 13, which also, as shown in FIG. 14, constitute rhombus configurations denoted by the diagrammatic figures 18 which extend between the centers of the projections 12, and it will be seen that said patterns touch each other at points, whereby the illustration clearly shows the relatively saturated occurrence of the projections 12 within the sheet 10, while at the same time, permitting the occurrence of the intermediate stress sections 16 between the individual, adjacent projections 12. Most importantly, however, it will be seen that the patterns 18 of the projections 12 comprise a structurally strategic geometric pattern of a density which repeatedly blocks straight lines of clear vision in all directions across the sheet and thereby, in accordance with a major objective of the present invention, this feature provides maximum rigidity to the structural member comprising sheet 10 with the projections 12 formed therein due to the interrelationship of the diameter of the projections and the center-to-center distance between adjacent projections.

Figure 4:
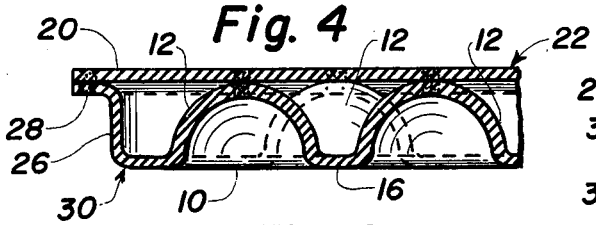
FIG. 4 is a fragmentary sectional view of a panel embodying the structural member shown in FIGS. 1-3 but to which a fragmentarily illustrated section of a top planar sheet has been affixed and said illustration being on a larger scale than in the preceding figures.
Figure 5:
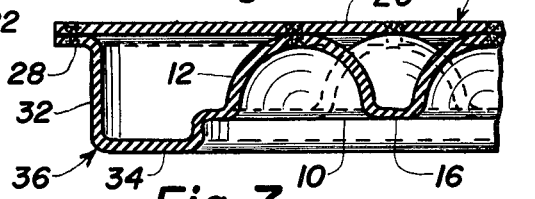
FIG. 5 is a fragmentary vertical sectional view similar to FIG. 4 but illustrating another embodiment of reinforcing flange from that shown in FIG. 4.

Another advantage of forming the projections 12 in dome-like configuration of a thickness no greater than that of the original sheet is that the same are readily capable of being formed to a substantial height from the original plane of the sheet 10 in which, for example, the intermediate stress sections 16 are disposed as shown in exemplary manner in FIG. 4, and also in FIG. 5, whereby the uppermost portions of the projections 12 are thinner than the lower portions thereof, while the intermediate stress sections 16 preferably retain optimum material, thereby providing maximum stress-resisting capabilities. Further, the formed structural member comprising the sheet 10 with the projections 12 formed therein may be produced by a simple form die arrangement. The shape of the projections 12 also is capable of being formed without rupture or shearing and, if desired, the resulting product may be imperforate. However, particularly when the structural member is employed in either a structural unit or finished structural panel through which, for example, cable cutouts or the like are desired, the structural member per se may be provided with suitable openings of limited diameter in appropriate locations through both the intermediate stress sections 16 or the outer ends, for example, of the projections 12, when desired, without detracting from the stress-resisting capabilities of the structural member, due to the isotropic properties of the unit.

In most applications of the invention, the structural member comprising the sheet 10 and the projections 12 formed therein is combined with a second planar sheet 20. Due to the fact that the upper ends of the projections 12 are substantially within a common plane, when the sheet 20 is abutted commonly with said outer ends of the projections 12, it may be secured to said upper ends by any appropriate means, such as welding, rivets, industrial adhesives, direct fusion, or any other known means of suitable nature, by which the planar sheet 20 is fixedly connected to said projections 12. This results in producing a structural unit which finds a most useful application when formed into a composite panel, several preferred embodiments of which are illustrated fragmentarily respectively in FIGS. 4 and 5 in vertical section and, correspondingly, and respectively, in FIGS. 6 and 7, in which fragmentary corners of a composite structural panel 22 of one embodiment, and a second embodiment 24 thereof, are shown in bottom plan view.

To form said composite panel, the edges of a finite shape and size of the sheet 10 with the projections 12 therein are bent upwardly at a right angle to form a reinforcing bracing flange 26 which has the same vertical dimension as the height of the projections 12 and, additionally, in the embodiments shown in FIGS. 4–7 and 10–13, the terminal edge portion of the bracing flange 26, which is continuous around all four sides of the composite panel, is bent outwardly at a right angle thereto to form preferably a continuous lip 28, the upper surface of which is in a plane common with that of the upper ends of the projections 12, whereby the second planar sheet 20 commonly abuts the upper surface of the lip 28 and the upper ends of all of the projections 12, it being understood that the planar sheet 20 also will be of substantially the same finite shape and size as that of the embodiment of structural member 30 to which it is fixedly connected.

As can be visualized from the illustration of the occurrence of the projections 12 within the sheet 10 of the structural member 30, especially as seen from FIG. 1, there is very frequent support afforded the second planar sheet 20, whereby a sheet of substantially reduced thickness may be utilized and still permit the same to afford resistance to indentation even by localized loads when applied to the planar sheet 20 of the composite structural panel 22 and the structurally strategic geometric pattern which embodies the unique relationship between the diameter of the projections and the center-to-center distance therebetween so as to provide increased resistance to deflection relative to strength-to-weight ratio and structural efficiency, even when subjected to substantial loads of either a uniform or concentrated nature.

Figure 6:
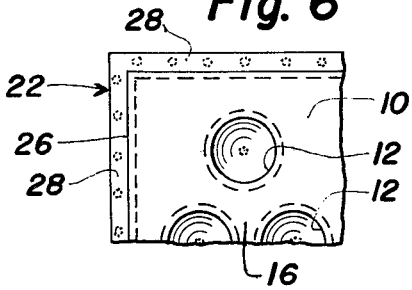
FIG. 6 is a fragmentary bottom plan view of a corner of the panel illustrated in FIG. 4 but shown on a smaller scale than employed in said figure.
Figure 7:
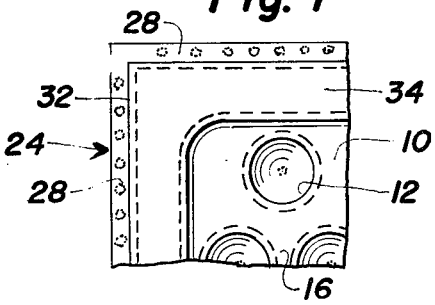
FIG. 7 is a view similar to FIG. 6 but showing a corner of the panel illustrated in FIG. 5 and using a smaller scale than employed in FIG. 5.

Referring to FIGS. 5 and 7, the composite structural panel 24 shown therein is similar to the panel shown in FIGS. 4 and 6, except that the bracing flange 32 thereof is of a greater depth than the height of the projections 12 and this is formed by means of depressing the peripheral sections 34 of the additional embodiment of structural member 36 from the remaining portions of the basic sheet 10 in a direction opposite to that from which the projections 12 extend, thereby producing a portion which extends oppositely to projections 12 and said bracing flange 32 is another portion which extends in the same direction as the projections 12 and is of greater vertical dimension than the flange 26 in the embodiment of FIG. 4. The resulting composite structural panel 24, shown in FIGS. 5 and 7 particularly adapts this embodiment of structural panel to provide support, especially by the corners thereof. This eliminates the need for supporting stringers between suitable pedestals, which, for example, are required in an elevated floor such as a so-called access floor in which a plurality of such structural panels are employed as floor panels and, under which circumstances, many available structural panels presently in use do not have the required rigidity along the edges thereof.

Notwithstanding the fact that the intermediate stress sections 16 of the embodiments of the invention shown in the foregoind figures are arcuate and somewhat sinuous in plan view, said stress sections are maintained in said configuration and are capable of not being moved therefrom when subjected to stress due to the fact that the circular configuration of the projections 12 in cross-section converts load stress to hoop stress adjacent to the opposite sides of said stress section. It is well known that a circular hoop is the strongest configuration for resting deformation from its original shape when forces are applied radially around the circumference thereof. As can be seen, especially from FIG. 1, the arcuate intermediate stress sections 16 extend substantially around all sides of the circular projections 12 and thereby utilize the hoop stress property of such projections advantageously for the stated purpose with respect to the stress sections 16.

Figure 8:
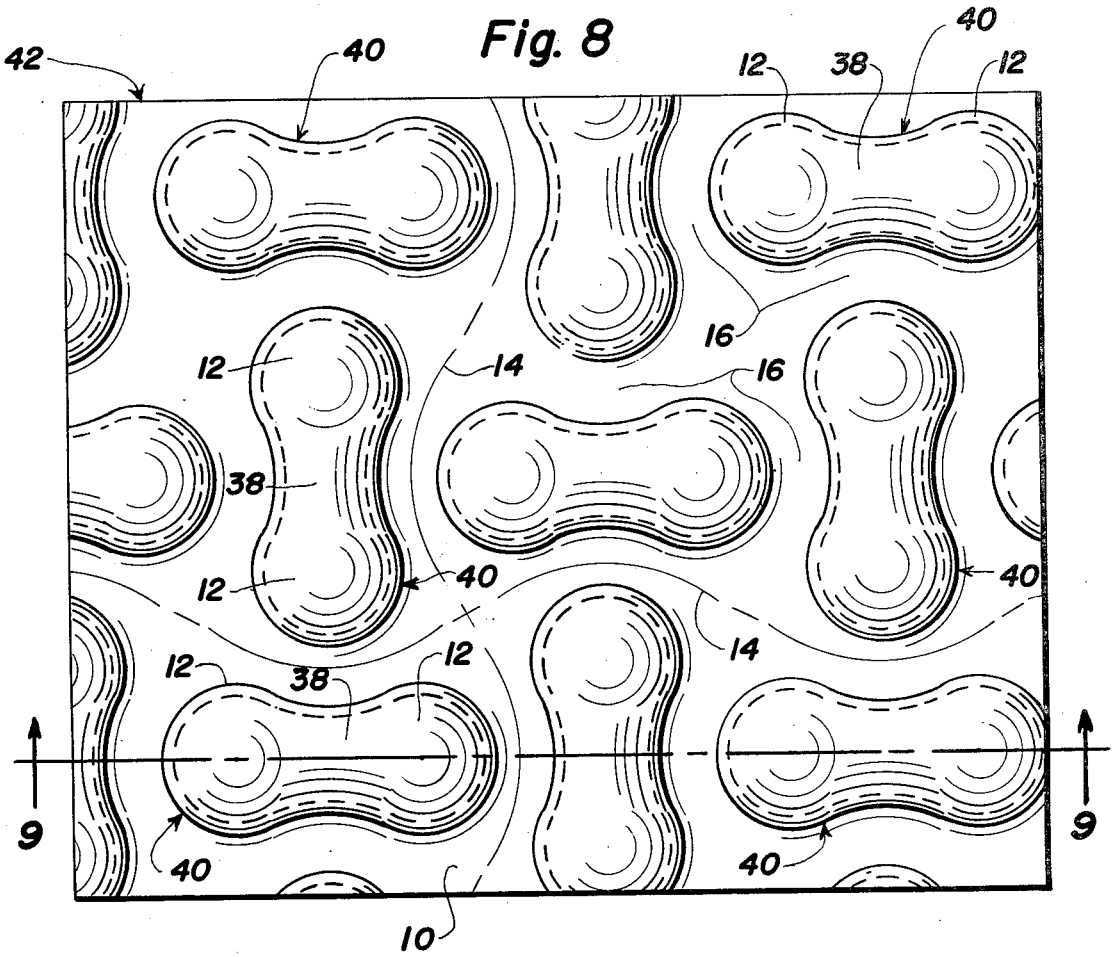
FIG. 8 is a fragmentary plan view of a structural sheet in which a different form of multiple dome-like projections is illustrated comprising elongated configurations and also illustrating in exemplary manner by broken lines, arcuate tracings of structural ribbon-like stress sections of fluctuating width and the scale of said figure being larger than that shown in FIG. 1.
Figure 9:
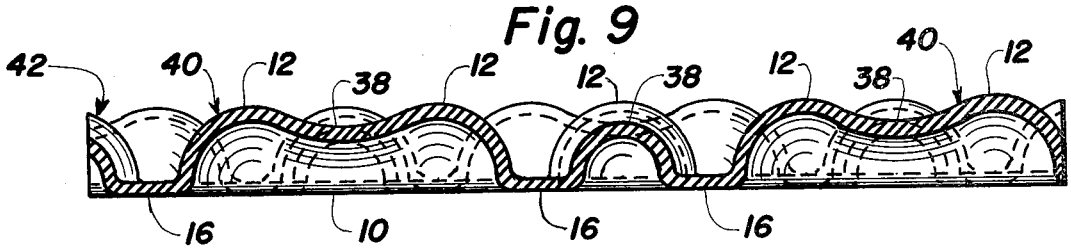
FIG. 9 is a transverse vertical section of the exemplary embodiment of structural member illustrated in FIG. 8, as seen on the line 9—9 thereof.

In addition to the embodiment of projections shown in the preceding figures, projections of other configurations may be utilized in accordance with the present invention, and one such additional embodiment of configuration thereof is illustrated in FIGS. 8–11 and 13, in which it will be seen that a plurality of circular projections 12 are arranged in pairs and connected by a saddle portion 38 which, as shown in cross-section in FIG. 9, does not usually project as far from the original plane of sheet 10 as the pair of projections 12 and, for example, especially from FIG. 8, it will be seen that the resulting elongated configurations 40, in plan view, closely resemble a figure 8, peanut-like in shape.

Further, the major portion of the perimeters, especially the perimeters of the opposite end portions of the configurations 40, are circular in plan view, thereby providing the aforementioned hoop stress which serves to maintain the intermediate stress sections 16. This is represented by the diagrammatic lines 14, in FIG. 1 which illustrate the sinuous shape thereof even when this embodiment of structural member 42 is subjected to loads. This is particularly advantageous when such member is included in a structural unit or structural panel in which the same is associated with and connected to a second planar sheet 20, as illustrated in the several embodiments respectively shown in FIGS. 10 and 11. The sheet 20 is affixed to the upper ends of the projections 12 of the elongated configurations 40 and the lip 28 which projects outwardly from the continuous bracing flange 26 arranged at the outer edge of the structural member 42 when the same is of finite shape and size corresponding to that of the planar sheet 20. Such connection is similar to that described above with respect to the embodiment shown in FIGS. 4 and 5, for example.

Figure 11:
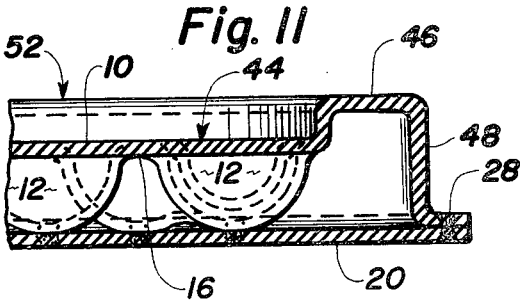
FIG. 11 is a fragmentary sectional view of a panel similar to that shown in FIG. 5 but in which the embodiment of structural member shown in FIGS. 8 and 9 is combined with a planar structural member to form said panel.

Further, for purposes of providing greater rigidity to the edges of the structural member and/or the composite structural panel in which it is included, reference is made to FIG. 11. This is similar to the previous embodiment shown in FIG. 5, in which the peripheral sections 46 of the basic sheet 10 are pressed away from the central portion of the sheet 10, oppositely to the direction in which the elongated configurations 40 extend, and thereby provide a bracing flange 48 of greater depth than the elongated configurations 40. This affords greater rigidity than under circumstances where the bracing flange is only as deep as the height of the projections 12 of the elongated configurations 40. The oppositely extending portions of this flange arrangement with respect to the projections 12 are clearly shown in FIG. 11.

Figure 12:
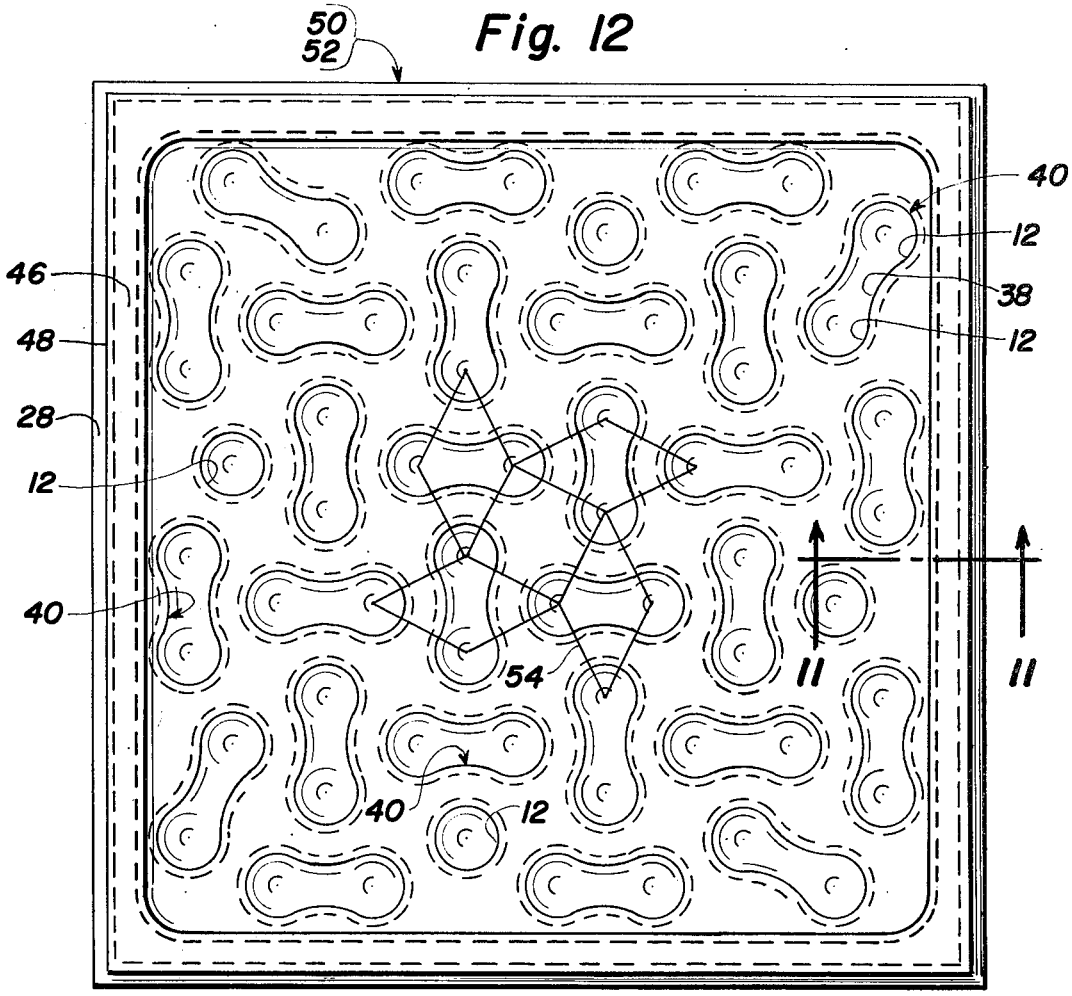
FIG. 12 is a bottom view of one embodiment of structural panel similar to that shown in FIGS. 8-11, and in which a pattern of the embodiment of projections illustrated in said figures have been included.

A more comprehensive concept of the several embodiments of composite panels is represented and illustrated in the several embodiments shown in the preceding figures. Attention is directed to FIGS. 12 and 13, in which in FIG. 13, the composite structural panels 22 and 24 are shown in bottom plan view and in FIG. 12, the bottom plan view of the further embodiments of composite structural panels 50 and 52 are shown, which correspond to the fragmentary vertical sections thereof, respectively shown in FIGS. 10 and 11. It also will be seen from FIG. 12 that the centers of the projections 12 which are formed in pairs to comprise the elongated configurations 40 are spaced relative to the centers of other projections in adjacent elongated configurations similarly to the projections 12 of the embodiments shown in FIGS. 1–7, whereby it will be seen in diagrammatic outline in FIG. 12 that the centers of the projections 12 also are disposed in rhombus patterns illustrated by the diagrammatic exemplary line pattern 54. From this, it will be seen that a similar frequency of the projections 12 is provided in the embodiment shown in FIG. 12 to provide the desired frequency of support for the upper planar sheet of the composite panel 50 and 52, which may be of substantially less thickness to resist indentation by concentrated loads than if such frequency of support were not provided for the lower surface of said upper planar sheet. This rhombus arrangement also comprises a basket weave pattern which can be visualized even more clearly from the diagrammatic illustration of FIG. 13 in which pairs equally spaced separate projections, also shown in FIG. 1, are illustrated in such basket weave pattern in which rows of pairs of equally-spaced in-line projections are interwoven perpendicularly relative to each other in such manner that the portion of a centerline of a row of such pairs of projections that lies between two aligned pairs bisects the pairs thereof in transverse rows.

For certain applications of the invention, it is conceivable that a pair of any of the above-described structural members may be disposed in abutting relationship with the projections 12 disposed in axial alignment fixedly connected together to provide composite structural members having very substantial rigidity and ability to resist flexure when loads are applied against either of the outer surfaces thereof.

Figure 16:
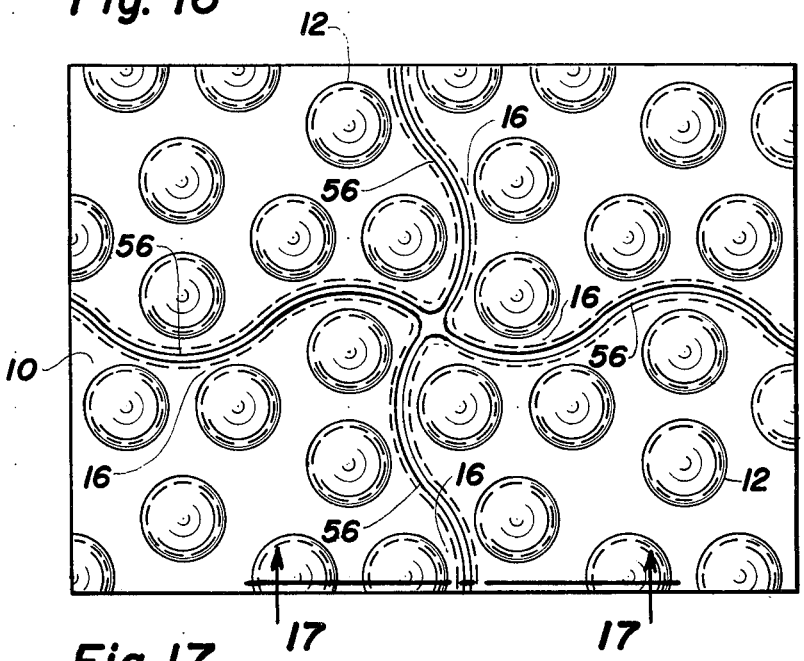
FIG. 16 is a fragmentary diagrammatic plan view similar to FIGS. 1 and 8, and in which additional embossed ribs have been formed in the arcuate structural ribbon-like stress sections of the structural member in transverse relationship.
Figure 17:
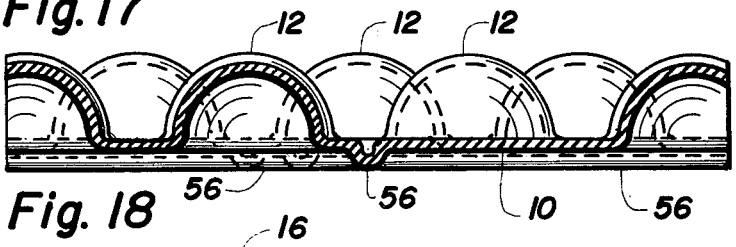
FIG. 17 is a fragmentary vertical sectional view illustrating on a larger scale than in FIG. 16, a sectional elevation of the embossed rib arrangement shown in FIG. 16, as viewed from the line 17—17.

Referring to FIG. 16, in which a fragmentary portion of the structural sheet 10 is specifically shown with circular projections 12 formed therein, the arcuate intermediate stress sections 16 may have the effectiveness thereof increased by forming in at least certain of said sections 16, an additional embossed rib 56, several of which are illustrated in exemplary manner in FIG. 16, and also in cross-section in FIG. 17, the latter figure being on a larger scale than that used in FIG. 16. The embossed ribs 56 generally follow the shape of the arcuate, ribbon-like intermediate stress sections 16. Although only a pair of the ribs 56 are shown in outline pattern in FIG. 16 in intersecting relationship, it is to be understood that any desired number of such additional reinforcing ribs may be employed, as desired, especially in relation to the rigidity required, commensurate with the thickness of the sheet 10 and the shape and spacings of the projections extending therefrom.

Figure 19:
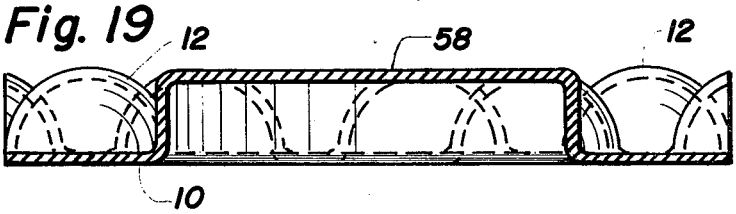
FIG. 19 is a fragmentary vertical sectional view shown on a larger scale than in FIG. 18 but illustrating a portion of the structural member shown in FIG. 18, as seen on the line 19—19 thereof.

Still another embodiment of patterns of projections which may be employed in accordance with the principles of the invention is illustrated in FIGS. 18 and 19, in which a fragmentary section of a sheet of structural material 10 is shown, and this particular illustration embodies a mixture of different shapes of projections, including the elongated configurations 40 which are more extensively illustrated in certain of the preceding figures, and also the circular configurations 12, which, similarly, are illustrated more extensively in certain of the preceding figures.

In addition to these previously described projections and elongated configurations, however, the embodiment shown in FIGS. 18 and 19 also includes a still further projection comprising a section 58, which is drawn from the original plane of the structural sheet 10, the drawn section 58 being of the same depth with respect to sheet 10, as the projections 12, but the same preferably is of greater area than the projections 12 and the elongated configurations 40, the same being surrounded in a pattern of such projections and configurations but in a manner so that the entire pattern repeatedly blocks straight lines of clear vision between any of the sides of the structural member when viewed along a plane parallel to the intermediate stress sections 16.

Figure 10:
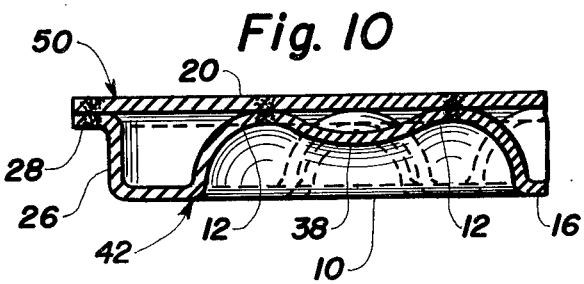
FIG. 10 is a fragmentary vertical sectional view of a panel embodying the structural member shown in FIGS. 8 and 9 associated with and affixed to an upper planar sheet, the scale being similar to that shown in FIG. 9.
Figure 20:
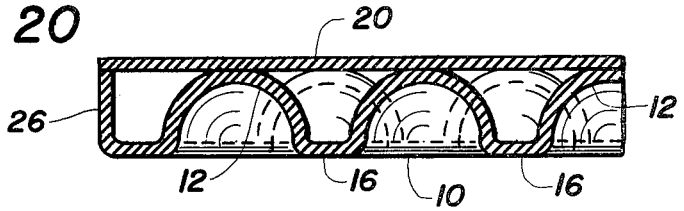
FIG. 20 is a fragmentary sectional view of a structural unit similar to FIG. 4 but in which the bracing flange is shown abutting the top sheet adaptable for direct connection thereto.
Figure 21:
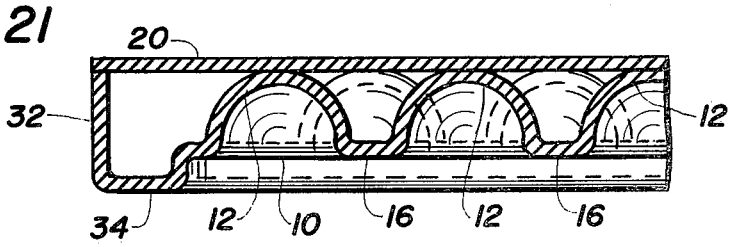
FIG. 21 is a view similar to FIG. 20 but in which the depth of the flange is greater than the height of the projections.

Still another embodiment of the invention is illustrated in FIGS. 20 and 21 in regard both to structural members 30 and 34 and similar structural members 42 and 44 of FIGS. 10 and 11, as well as to the composite structural panels 22, 24 and 50, 52 in which they respectively are included. This embodiment comprises terminating the bracing flanges 26 and 28 in these respective structural members and composite structural panels at the upper ends and omit the lips 28 thereon, thus butting the upper ends of the flanges directly against the adjacent surfaces of the top planar sheets 20 in said members and panels and connecting said upper ends of the flanges fixedly to the perimeters of said top planar sheets which also terminate at the vertical plane of the outside surfaces of said bracing flanges, as clearly shown in FIGS. 20 and 21. Under such circumstances, when the structural panels thus formed are used in an access floor, the outer surfaces of said bracing flanges of adjacent panels closely interfit in the overall access floor.

Figure 22:
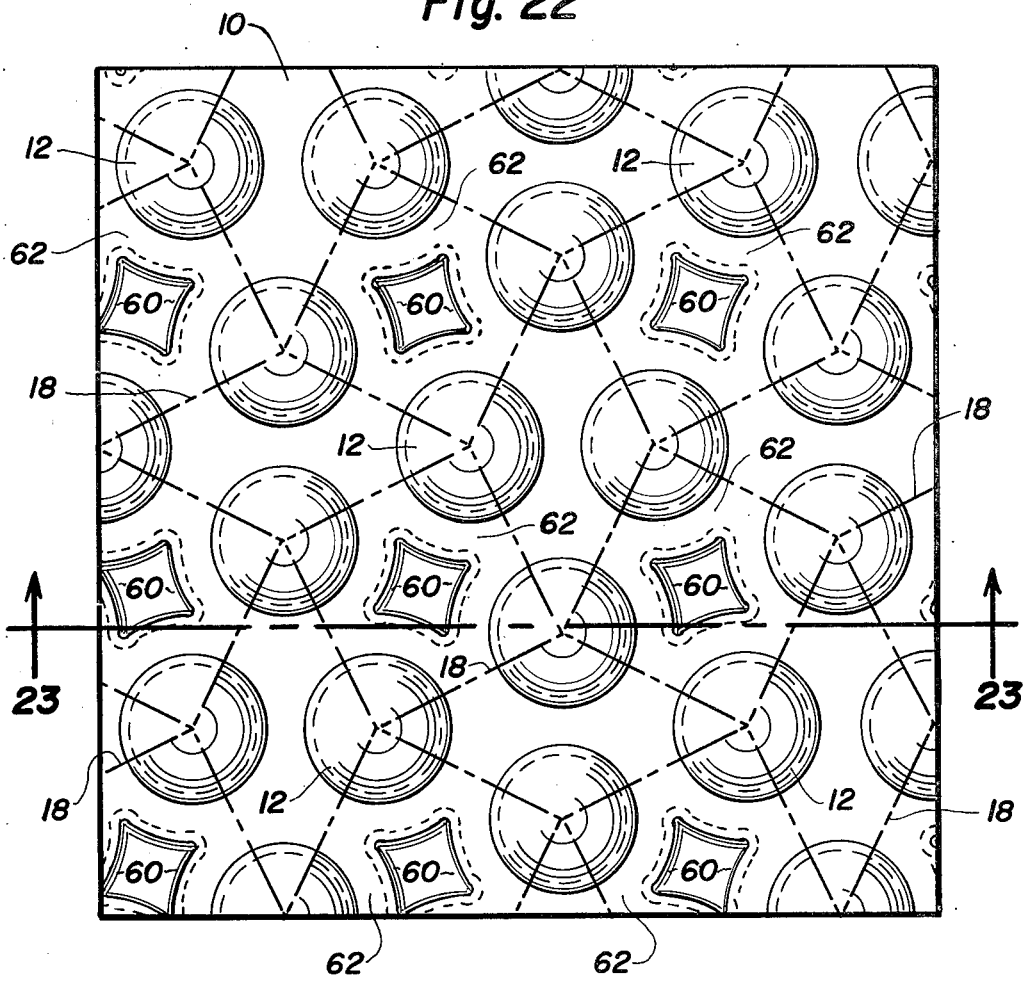
FIG. 22 is a fragmentary plan view of a further embodiment similar to FIG. 14 but in which additional protrusions are included within the stress sections.
Figure 23:
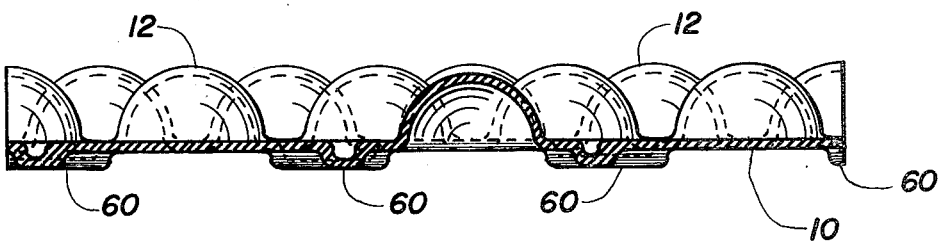
FIG. 23 is a fragmentary sectional view as seen on line 23—23 of FIG. 22.
Figure 13:
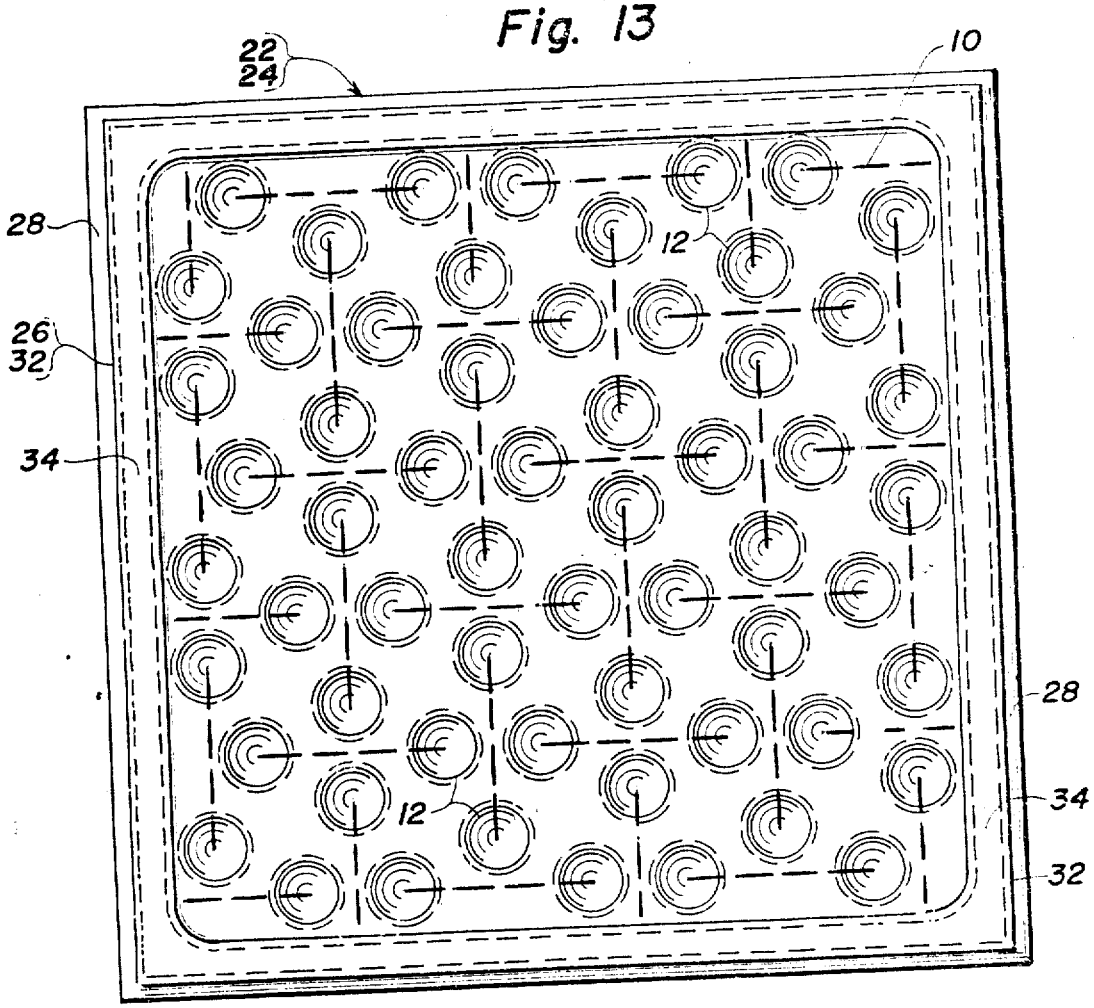

Still a further embodiment of the invention is illustrated in FIGS. 22 and 23, and similarly to the embodiment illustrated in FIGS. 16 and 17, increases the effectiveness of the arcuate intermediate stress sections 16. Specifically, additional protrusions 60 are formed in stress sections 16 between projections 12 and of less height than projections 12. As previously discussed in reference to FIG. 14, projections 12 are positioned in a manner that form rhombus configurations denoted by diagrammatic figures 18. The additional protrusions 60 are preferably positioned in the center of the squared areas 62 between the rhombus patterns 18 and are sized so as to retain a planar portion of each stress section 16, said portions being located between protrusions 60 and projections 12 forming the corners of the squared areas 62. The acceptance of tension and compression stresses by stress sections 16 are, therefore, substantially unaffected by the inclusion of protrusions 60 since the stresses are resisted by being distributed around the protrusions 60. At the same time the section modulus of the sheet can be increased with an attendant gain in rigidity.

The embodiment of FIGS. 22 and 23 can be advantageous in specialized applications requiring a small but, nevertheless increased rigidity of the embodiment of FIG. 13, but could be undesirable if the application was such that an increased section depth was undesirable. By way of example and with reference to FIG. 20, if protrusions 60 were formed in stress sections 16 and extended from the sheet in a direction opposite to the projections 12, the increased thickness of the sheet might render it undesirable in those installations requiring small clearance between sub-floor and panel.

From the foregoing, it will be seen that the present invention provides a plurality of embodiments of structural members and composite structural panels which include the same and in which such panels are relatively of light weight and embody optimization of support by utilizing the most effective strength-to-weight ratio and structural efficiency and embodying maximum resistance to deflection, as well as resistance to indentation of the planar top sheet of such panels due to the frequency of structural support therefor by projections in the structural members included therein. For maximum support of the planar sheets 20 by projections 12 in the sheet 10, it will be seen in the various illustrated embodiments that additional single projections not comprising parts of pairs thereof or of the basket weave patterns or rhombus configurations are included in the sheets 10 and are similar to the projections in the patterns thereof to occupy areas of sheet 10 which would otherwise not offer desired support to the planar sheets 20 of the composite structures and structural units of the invention.

TEST DATA

To demonstrate the significantly improved characteristics and performance of the present invention, comparisons have been made with access floor panels disclosed in prior art and commercially available. Comparisons have been made on a "strength-to-weight" basis, and a "structural efficiency ratio" basis, both described more fully below. Of existing prior art panels, there are some which have comparable resistance to flexure when loaded either at the center of the panel and/or at the midspan of the perimeter, but which require significantly greater material by weight and/or depth of section. For prior art panels to have comparable performance, they would require additional material and/or greater depth of section, thus demonstrating lower structural efficiency which is needed to develop required moment of inertia. By combining material mass weight savings, thinner depth of section, and deflection performance, the panels of the present invention demonstrate a marked improvement in actual structural efficiency. In some instances, the improvement is in excess of 150%.

Strength-to-weight ratio, in the context of the present invention, is used to relate deflection under a given load to the mass weight of the material. Expressed as the following formula:

$$\frac{\text{Deflection of Unit \#1}}{\text{Deflection of Unit \#2}} \times \frac{\text{Mass Weight Unit \#1}}{\text{Mass Weight Unit \#2}} \times 100$$

the result is a numerical performance ratio, expressed as a percentage of access floor unit #1 (prior art) to access floor unit #2 (present invention).

Data employed in the formula for the present invention is an average of 3 random samples taken from a test run, and data for panels of the prior art is derived from sample panels available on the market.

The "structural efficiency ratio" is a comparative ratio that relates deflection, mass weight, and section depth. In essence, it is a measure of the efficiency of the panel section in its utilization of the mass of the material. Expressed as the following formula:

$$\frac{\text{Deflection Unit \#1}}{\text{Deflection Unit \#2}} \times \frac{\text{Mass Weight Unit \#1}}{\text{Mass Weight Unit \#2}} \times \left(\frac{\text{Section Depth Unit \#1}}{\text{Section Depth Unit \#2}}\right)^2 \times 100$$

the result is a numerical structural efficiency ratio, expressed as a percentage of access floor unit #1 (prior art) to access floor unit #2 (present invention). As before, the data employed in the formula for the present invention is an average of three sample panels taken from a test run and the data for the prior art panel is derived from sample panels available on the market.

The test method was identical for all panels tested. Three panels were selected at random from a test run of panels of the present invention and were tested along with commercially available sample panels available on the market. Each panel was placed on rigid pedestal supports without the use of edge stringers. Concentrated loads of identical magnitude were applied to the center of the panel and at mid-span of the perimeter. Deflection readings were recorded from the bottom of the panel directly under the load. All panels were reloaded with deflection recorded again. On each loading sequence, the permanent set was also recorded.

The following chart expresses relative "strength to weight" and "structural efficiency" ratios. The differences in these parameters are stated as a percentage improvement of the performance of panels of the present invention. Note that the present invention had performances superior to prior art panels and/or panels presently available on the market. As a base, the average weight of the panels of the present invention was 20¼ lbs.

| MODEL or NAME | REF. PATENT NO. | INDUSTRY IDENTIFICATION | SAMPLE PANEL WEIGHT | EDGE STRENGTH-TO-WEIGHT RATIO | EDGE STRUCTURAL EFFICIENCY RATIO | CENTER STRENGTH-TO-WEIGHT RATIO | CENTER STRUCTURAL EFFICIENCY RATIO |
|---|---|---|---|---|---|---|---|
| MARK 30 | 3,696,578 to Swenson Oct. 10, 1972 | Liskey Architectural | 25.75 lb. | 30.1% | 20.3% | 2.3% | 75.2% |
| MARK 40 | 3,696,578 believed to be to Swenson Oct. 10, 1972 | Liskey Architectural | 21.75 lb. | 8.6% | 17.0% | 56.8% | 182.4% |
| MODEL 50 | Non-determined | Donn Products | 24.5 lb. | 73.2% | 57.8% | 67.0% | 193.8% |
| MULT-A-FRAME | Similar to 2,391,997 to Noble Jan. 1, 1946 | Mult-A-Frame | 24.5 lb. | 69.1% | 35.0% | 49.0% | 129.6% |
| WACO-PLATE | 3,258,892 to Rushton July 5, 1966 | Washington Aluminum | 31 lb. | 183.6% | 77.5% | 109.8% | 153.3% |

As can be seen from the above data, the present invention demonstrates a dramatic improvement in structural efficiency and strength-to-weight ratios over all available prior art panels and panels currently being marketed. The present invention offers a reduction in material usage over all panels to which it was compared. It provides improved resistance to flexure when loaded and utilized as an access floor panel.

The foregoing specification illustrates preferred embodiments of the invention. However, concepts employed may, based upon such specification, be employed in other embodiments without departing from the scope of the invention. Accordingly, the following claims are intended to protect the invention broadly, as well as in the specific forms shown herein.

We claim:

1. A sheet of structural material having formed therefrom a plurality of similar dome-like projections extending from the plane of said sheet and of which at least a major portion of the configuration of each projection is circular in plan view, said projections in the plane of said sheet being arranged in a structurally strategic geometric pattern in which rows of equally-spaced pairs of in-line projections are interwoven perpendicularly with other such rows of pairs in a basket weave fashion so that the portion of a centerline of a row of pairs of projections that lies between two aligned pairs bisects the pairs thereof in transverse rows and has sufficient pattern density to block straight lines of clear vision repeatedly in all directions across said sheet to form a one-piece rigid structural member capable of resistance to flexure and the portions of said member which are intermediately between said projections comprising continuous structural ribbonlike stress sections of fluctuating width and arcuate in plan view capable of optimizing stress-resisting integrity.

2. The structural member according to claim 1 in which at least the majority of said projections in plan view are also combined in groups of four arranged in a rhombus pattern and adjacent rhombus patterns being positioned in a close perpendicular basket weave orientation and thereby locating said projections to repeatedly block said clear lines of vision as aforesaid.

3. The structural member according to claim 2 in which stiffening protrusions are formed in said sheet within the areas between said rhombus patterns of projections to a depth less than the depth of said projections.

4. The structural member according to claim 1 in which said projections are arranged in pairs connected by a saddle portion forming an elongated configuration which in plan view generally resembles a figure 8, and the ends of said projections being circular and said elongated configurations being arranged in a substantially perpendicular basket weave pattern having a strategic dimensional relationship between the diameter of said projections and the center-to-center distances therebetween and of which in plan view the end of one projection interfits with the adjacent configuration, thereby repeatedly blocking straight lines of vision laterally in all directions across said sheet as aforesaid.

5. The structural member according to claim 1 wherein said projections are in close proximity to each other within said pattern and in which certain of said projections are circular in cross-section and others are in plural arrangements to form projecting elongated configurations which resemble at least a figure 8 in plan view, at least the major portions of the circumference of all said projections being circular in plan view, and the combination of said projections in said sheet being such as to repeatedly block straight lines of clear vision across said sheet in all directions through said pattern of projections.

6. The structural member according to claim 5 further including at least one section drawn from the original planar sheet in the same direction as said projections from said sheet, said sections having an area larger than said projections and surrounded in said pattern by said projections, and the arrangements of said projections and drawn section of said entire pattern being designed so as to repeatedly block straight lines of clear vision across said sheet in all directions through said pattern.

7. The structural member according to claim 1 wherein all surfaces of said projections and the junctures thereof with said intermediate structural stress sections in said original plane of said sheet are free from sharp angles or bends, whereby there are no areas or portions in said sheet which comprise corners or other shapes which normally tend to pucker or otherwise resist formation of smoothly stretched areas when formed from a planar sheet and subjected to shaping by dies.

8. The structural member according to claim 1 combined with a similar member with the outer ends of said projections being fixedly attached to form a composite structural unit capable of resistance to flexure with said projections serving as arches to resist flexure and hemispherical shape of said projections providing resistance to collapse thereof.

9. The sheet of structural material according to claim 1 in which said sheet is steel.

10. A structural unit comprising a sheet of structural material having formed therein a plurality of similar dome-like projections of no greater thickness than said sheet and extending from the plane of said sheet and of which at least the major portion of the circumference of each projection is circular in plan view, said projections in the plane of said sheet being arranged in a structurally strategic geometric pattern in which rows of equally-spaced pairs of in-line projections are interwoven perpendicularly with other such rows of pairs in a basket weave fashion so that the portion of a centerline of a row of pairs of projections that lies between two aligned pairs bisects the pairs thereof in transverse rows and has sufficient pattern density to block all straight lines of clear vision repeatedly in all directions across said sheet, and the portions of said member which are intermediately between said projections comprising continuous structural ribbon-like sections of fluctuating width and arcuate in plan view, capable of optimizing stress-resisting integrity and said sections extending between the opposite edges of said sheet and being capable of maintaining resistance of the load stresses throughout said member and also capable of being maintained in the stated shape thereof when under stress by the circular configurations of said projections preventing movement thereof, said member being combined with a planar sheet fixedly secured to the outer terminal ends of said projections, thereby providing a composite structural unit in which the optimization of support versus strength-to-weight ratio and structural efficiency is achieved, whereby when said planar sheet is subjected to loading said projections serve as arches to resist flexure and the hemispherical shape of said projections providing resistance to collapse thereof.

11. The structural unit according to claim 10 in which the bases of said projections formed in said sheet of planar material are substantially circular.

12. The structural unit according to claim 11 in which the pattern of said projections and the formation thereof from said sheet produces resistance to flexure in said structural unit which is substantially isotropic when said unit is penetrated by an opening of limited cross-section located inward from the edges thereof, thereby substantially retaining its resistance to flexure without directional weakness due to the resulting stresses in said unit when under load being redirected around said opening.

13. The structural unit according to claim 11 in which at least the majority of said projections in plan view are also combined in groups of four arranged in a rhombus pattern and adjacent rhombus patterns being positioned in close perpendicular basket weave orientation and thereby locating said projections to repeatedly block said clear lines of vision as aforesaid.

14. The structural unit according to claim 13 in which stiffening protrusions are formed in said sheet within the areas between said rhombus patterns of projections to a depth less than the depth of said projections.

15. The structural unit according to claim 10 in which said projections are arranged in pairs and in which each projection extends from the same surface of said sheet and is connected by a saddle portion extending in the same direction from the original plane of said sheet to form elongated configurations which in plan view generally resemble a FIG. 8, peanut-like in shape, and the ends of said projections being circular and said elongated configurations being arranged in a substantially perpendicular basket weave pattern in which in plan view the end of one elongated configuration interfits with the adjacent configuration, thereby repeatedly blocking straight lines of vision in all directions across said sheet as aforesaid.

16. The structural unit according to claim 15 in which the pattern of said projections and the formation thereof from said sheet produces resistance to flexure in said structural unit which is substantially isotropic when said unit is penetrated by an opening of limited cross-section located inward from the edges thereof thereby substantially retaining its resistance to flexure without directional weakness due to the resulting stresses in said unit when under load being redirected around said opening.

17. The structural unit according to claim 10 wherein said projections are in close proximity to each other within a pattern and in which certain of said projections are circular in cross-section and others are in plural arrangements to form elongated configuration of projections connected by saddle portions to resemble at least a FIG. 8 in plan view and at least the major portion of the circumference of all of said projections in said plural arrangements being circular in plan view, the combination of said projections in said sheet being such as to repeatedly block straight lines of clear vision in all directions across said sheet through said pattern of projections.

18. The structural unit according to claim 17 further including at least one drawn section formed from the original planar sheet in the same direction as said projections from said sheet, said section having an area larger than said projections and surrounded in said pattern by said projections, the arrangement of said projections and drawn section of said entire pattern being designed so as to repeatedly block straight lines of clear vision across said sheet in all directions through said pattern.

19. The structural unit according to claim 10 further including a rib extending from within said arcuate members to further increase the rigidity of said structural unit to resist flexure under stress.

20. The structural unit according to claim 10 wherein said structural unit is of given finite size, the peripheral edge of the portions of said original planar material extending at right angles to said planar material to form a continuous bracing flange around the periphery of said structural unit, and means fixedly connecting said planar sheet to said bracing flange and the upper surfaces of the upper ends of said projections to form a rigid panel constructed to be supported selectively at the edges or corners thereof and capable of sustaining substantial uniform or concentrated loads without appreciable deflection or permanent set.

21. The rigid panel according to claim 20 in which said peripheral bracing flange has a greater transverse depth than the height of said projections and said peripheral bracing flange providing a perimeter of increased strength, said perimeter having one portion extending in the opposite direction to said projections relative to the original plane of said sheet and an additional portion extending in the same direction as said projections from said original plane of said sheet.

22. The rigid panel according to claim 18 in which said additional portion terminates in a flange bent outward at a right angle to said additional portion to form a peripheral lip parallel to the plane of said intermediate portions of said member between said projections, and means fixedly connecting said peripheral lip to said planar top sheet.

23. The rigid panel according to claim 20 wherein the outer extremities of said edge portions of said formed bracing flange are also bent outward at a right angle to said flange to form a peripheral lip parallel to the plane of said intermediate portions of said member between said projections, and means fixedly connecting said peripheral lip to said planar top sheet.

24. The structural unit according to claim 10 in which said sheet of structural material and said planar sheet are steel.

25. The structural unit according to claim 24 in which said planar sheet is secured to said outer terminal ends of said projections by welding.

* * * * *

UNITED STATES PATENT AND TRADEMARK OFFICE
CERTIFICATE OF CORRECTION

PATENT NO. : 4,203,268

DATED : May 20, 1980

INVENTOR(S) : Robert S. Gladden, Jr., et al

It is certified that error appears in the above—identified patent and that said Letters Patent is hereby corrected as shown below:

Fig. 13 of the drawing figures should appear as shown on the attached sheet.

Signed and Sealed this

*Eighteenth* Day of *November 1980*

[SEAL]

*Attest:*

SIDNEY A. DIAMOND

*Attesting Officer*

*Commissioner of Patents and Trademarks*